US008217740B2

(12) United States Patent
Nakagawa

(10) Patent No.: US 8,217,740 B2
(45) Date of Patent: Jul. 10, 2012

(54) ELECTROMAGNETIC RELAY

(75) Inventor: Eiji Nakagawa, Kariya (JP)

(73) Assignee: Denso Corporation, Kariya, Aichi-Pref. (JP)

( * ) Notice: Subject to any disclaimer, the term of this patent is extended or adjusted under 35 U.S.C. 154(b) by 103 days.

(21) Appl. No.: 12/787,781

(22) Filed: May 26, 2010

(65) Prior Publication Data

US 2010/0301974 A1 Dec. 2, 2010

(30) Foreign Application Priority Data

May 28, 2009 (JP) ..... 2009-128442

(51) Int. Cl.
*H01H 85/00* (2006.01)
*H01H 7/16* (2006.01)
*H01H 67/02* (2006.01)

(52) U.S. Cl. ..... 335/132; 335/156; 337/1; 337/2; 337/4

(58) Field of Classification Search ..... 335/132, 335/156; 337/1, 2, 4–7, 11, 12
See application file for complete search history.

(56) References Cited

FOREIGN PATENT DOCUMENTS

| | | |
|---|---|---|
| JP | 2002-208338 | 7/2002 |
| JP | 2002-324478 | 11/2002 |
| JP | 2005-005243 | 1/2005 |
| JP | 2005-347116 | 12/2005 |

OTHER PUBLICATIONS

Japanese Office Action dated Feb. 15, 2011, issued in corresponding Japanese Application No. 2009-128442 with English Translation.

*Primary Examiner* — Ramon Barrera
(74) *Attorney, Agent, or Firm* — Nixon & Vanderhye PC

(57) ABSTRACT

An electromagnetic relay comprises a coil generating magnetic force when power is distributed, a contact point part opened and closed by the magnetic force, and a fuse functional part having a conductor wired electrically in series with the contact point part and disconnected when predetermined heat quantity is received, and the fuse functional part is disposed at a position which receives arc heat generated in the contact point part when switching the contact point part from conduction state to cut-off state. Thereby, a small electromagnetic relay which enables interruption of current in all current value range can be provided.

7 Claims, 12 Drawing Sheets

ELECTROMAGNETIC RELAY

CROSS REFERENCES TO RELATED APPLICATION

The present application relates to and incorporates by reference Japanese Patent application No. 2009-128442 filed on May 28, 2009.

BACKGROUND OF THE INVENTION

1. Field of the Invention

The present invention relates to an electromagnetic relay which opens and closes a contact point part using magnetic force generated when power is distributed to a coil.

2. Description of the Related Art

As shown in FIG. 1, an electromagnetic relay 9 is incorporated in a power circuit 50 for switching a current flowing in a power circuit 50 in the conduction state or a cut-off state in order to drive a travelling motor in vehicle such as a hybrid vehicle, an electric vehicle etc. Moreover, a fuse functional part 40 which shuts off the current by disconnecting due to Joule heat when unusual large current flows is also incorporated in the power circuit 50.

The electromagnetic relay 9 and the fuse functional part 40 are wired in series mutually. By shutting off either, power distribution in the power circuit 50 is stopped.

In FIG. 1, a reference symbol 51 indicates a high-voltage battery, a reference symbol 52 indicates a rotating electric machine made of a three-phase AC travelling motor, a reference symbol 53 indicates an inverter which converts DC power (AC power) to AC power (DC power). Here, the fuse functional part 40 is incorporated inside the high-voltage battery 51.

As shown in FIG. 2, the electromagnetic relay 9 has a contact point part 93 comprising a movable contact point 931 which is opened and closed by magnetic force generated by a coil 92 and a fixed contact point 932. A pair of the fixed contact points 932 is held by the fixed holder 934, and a pair of the movable contact points 931 is held by the movable holder 933 so as to mutually short-circuit.

In the above conventional electromagnetic relay 9, when power is distributed to the coil 92, the contact point part 93 is closed by magnetic force generated by the coil 92 whereby a conduction state is formed. On the other hand, when power is not distributed to the coil 92, magnetic force generated by the coil 92 disappears. Thereby the contact point part 93 is opened and a cut-off state is formed.

In such a configuration, when abnormality occurs in the power circuit 50 shown in FIG. 1, power distribution to the power circuit 50 can be interrupted by sending a signal to the electromagnetic relay 9 for making the electromagnetic relay 9 in the cut-off state.

Meanwhile, when the large current beyond a predetermined value flows, power distribution to the power circuit 50 can be interrupted by fusing the fuse functional part 40 by Joule heat.

However, when the electromagnetic relay 9 shifts to the cut-off state from the conduction state, an arc 8 may be generated in the contact point part 93 as shown in FIG. 3. For extinguishing the arc 8, an electromagnetic relay is disclosed in a Japanese Patent Application Laid-Open Publication No. 2005-347116, where the electromagnetic relay has arc-extinguishing magnets (not shown in the drawing) disposed lateral to the contact point part 93 so as to sandwich the contact point part 93.

However, in case that the current which was flowing in the electromagnetic relay 9 before being interrupted is a large current, it is difficult to extinguish the arc 8. Moreover, if the arc 8 continues too long, the arc heat will have a bad influence on surrounding parts. That is, there is an upper limit to the current value which can be interrupted in the electromagnetic relay 9. In order to raise the upper limit, it is necessary to enlarge distance H between contact points in the cut-off state. In this case, since larger magnetic force is required when switching the electromagnetic relay 9 from the cut-off state to the conduction state, the coil 92 is required to be larger. Consequently, the electromagnetic relay 9 is also required to be larger.

On the other hand, the fuse functional part 40 is disconnected by receiving a predetermined heat quantity. If the current value which can fuse the fuse functional part 40 is set low, the fuse functional part 40 may be disconnected even at the normal time. Therefore, it is necessary to set the fuse functional part 40 so that it may be disconnected when an unusual large current, far exceeding the current value which can flow at the normal time, flows.

That means, in the case that a large-sized electromagnetic relay is not adopted, there will be a current value which is not only larger than the upper limit which can be interrupted in the electromagnetic relay 9, but also smaller than the unusual large current, which can be interrupted in the fuse functional part 40, far exceeding the current value which can flow at the normal time. In other words, there is a current range which cannot be interrupted in either the electromagnetic relay 9 only or the fuse functional part 40 only. For this reason, there is a problem that it is difficult to manage an abnormality occurring while the current in this range flows.

SUMMARY

The present exemplary embodiment has been made in view of such conventional problems, and thus, it is an object of the present exemplary embodiment to provide a small electromagnetic relay which enables interruption of current in all current value ranges.

In order to achieve the aforementioned object, the present exemplary embodiment provides an electromagnetic relay comprising a coil generating magnetic force when powered, a contact point part opened and closed by the magnetic force, and a fuse functional part having a conductor wired electrically in series with the contact point part and disconnected when a predetermined heat quantity is received, and the fuse functional part being disposed at a position which receives arc heat generated in the contact point part when switching the contact point part from conduction state to cut-off state.

The electromagnetic relay incorporates the fuse functional part disposed at a position where the fuse functional part receives the arc heat. Thereby, when the contact point part is switched from conduction state to cut-off state, the fuse functional part receives not only the Joule heat generated by the current flowing in the fuse functional part, but also the arc heat transmitted from the contact point part. Therefore, even if a current in the range which cannot be interrupted in either the fuse functional part only or the contact point part only flows, the current can be interrupted in a short time.

That is, at the normal time, it is necessary to avoid a situation that only the fuse functional part is disconnected but the contact point part is not interrupted. Therefore, disconnection of the fuse functional part without interrupting the contact point part should be made only when an unusual large current, far exceeding the current value which can flow at the normal time, flows. To do that, it is necessary to provide a fuse functional part which is disconnected only when large heat quantity which is not generated at the normal time is received.

On the other hand, in the contact point part, when small current flows, since extinguishing an arc is easy, interruption of the current is also easy. However, when to some extent large current flows, since extinguishing the arc is difficult, interruption of the current in the contact point part only becomes difficult. This problem can be solved by making the electromagnetic relay larger as described above, but this accompanies large disadvantage.

So when interruption of current is performed in the current value range between the current value range which can be interrupted only in the contact point part, and the current value range which can be interrupted only in the fuse functional part, an arc is generated in the contact point part by switching the contact point part from conduction state to cut-off state. Then the fuse functional part can be disconnected by superimposing the arc heat on Joule heat. Thereby, interruption of current is attained in all current value ranges.

Moreover, when interrupting the large current which can be interrupted only in the fuse functional part, interruption may take time depending on the current value. Also in this case, by generating an arc by switching the contact point part to cut-off state, then by superimposing the arc heat on Joule heat, time taken to disconnect the fuse functional part can be shortened.

Moreover, since interruption only in the contact point part can be performed only in the case where the current value is small as described above, whereby downsizing of the electromagnetic relay may become easy. Furthermore, the fuse functional part is incorporated in the electromagnetic relay, whereby number of parts of circuit system incorporated in the electromagnetic relay may be reduced.

As described above, according to the present exemplary embodiment, a small electromagnetic relay which enables interruption of current in all current value ranges can be provided.

The electromagnetic relay of the present exemplary embodiment can be incorporated in a power circuit for driving a travelling motor of a vehicle such as a hybrid vehicle, an electric vehicle, etc.

Preferably, the electromagnetic relay may further comprise a pair of fixed holders fixed to a main body and holding a pair of fixed contact points, and a movable holder holding in a short-circuited state a pair of movable contact points disposed oppositely to the pair of fixed contact points, wherein the contact point part is composed of the pair of fixed contact points and the pair of movable contact points, and the fuse functional part constitutes a part of the movable holder.

According to this configuration, since arc heat is transmitted from two directions to the fuse functional part, fusing in a short time of the fuse functional part becomes easy. Moreover, the fuse functional part can be easily incorporated in the electromagnetic relay whereby a small electromagnetic relay can be obtained.

It is preferable that the electromagnetic relay may further comprise a pair of fixed holders holding a pair of fixed contact points fixed to a main body, and a movable holder holding in a short-circuited state a pair of movable contact points disposed oppositely to the pair of fixed contact points, wherein the contact point part is composed of the pair of fixed contact points and the pair of movable contact points, and the fuse functional part constitutes a part of at least one of the fixed holder.

According to this configuration also, the fuse functional part can be provided in the position where arc heat is fully transmitted.

It is preferable that the fuse functional part may be configured to adjust a current value range which disconnects the fuse functional part with the arc heat and Joule heat generated by current flowing in the fuse functional part by adjusting at least one of a length and an cross-sectional area of the conductor interposed between the contact point part and the functional part.

According to this configuration, the current value range which disconnects the fuse functional part with arc heat and Joule heat can be set easily.

More precisely, the current value range which disconnects the fuse functional part with arc heat and Joule heat can be shifted to the lower one by shortening a length of the conductor or by changing a cross-sectional area to become larger, whereby downsizing of the electromagnetic relay becomes easy.

Alternatively, the current value range which disconnects the fuse functional part with arc heat and Joule heat can be shifted to the higher one by lengthening the length of the conductor or by changing the cross-sectional area to become smaller.

It is also preferable that the contact point part and the fuse functional part may constitute a cartridge part which is detachable from a coil unit containing the coil.

According to this configuration, in case that the fuse functional part is disconnected or the contact point part is damaged, the contact point part and the fuse functional part can be removed from the coil unit then replaced.

DETAILED DESCRIPTION OF PREFERRED EMBODIMENTS

First Embodiment

Hereinafter, an electromagnetic relay concerning an embodiment of the present invention will be described referring to FIG. 4-FIG. 11.

Figure 1:
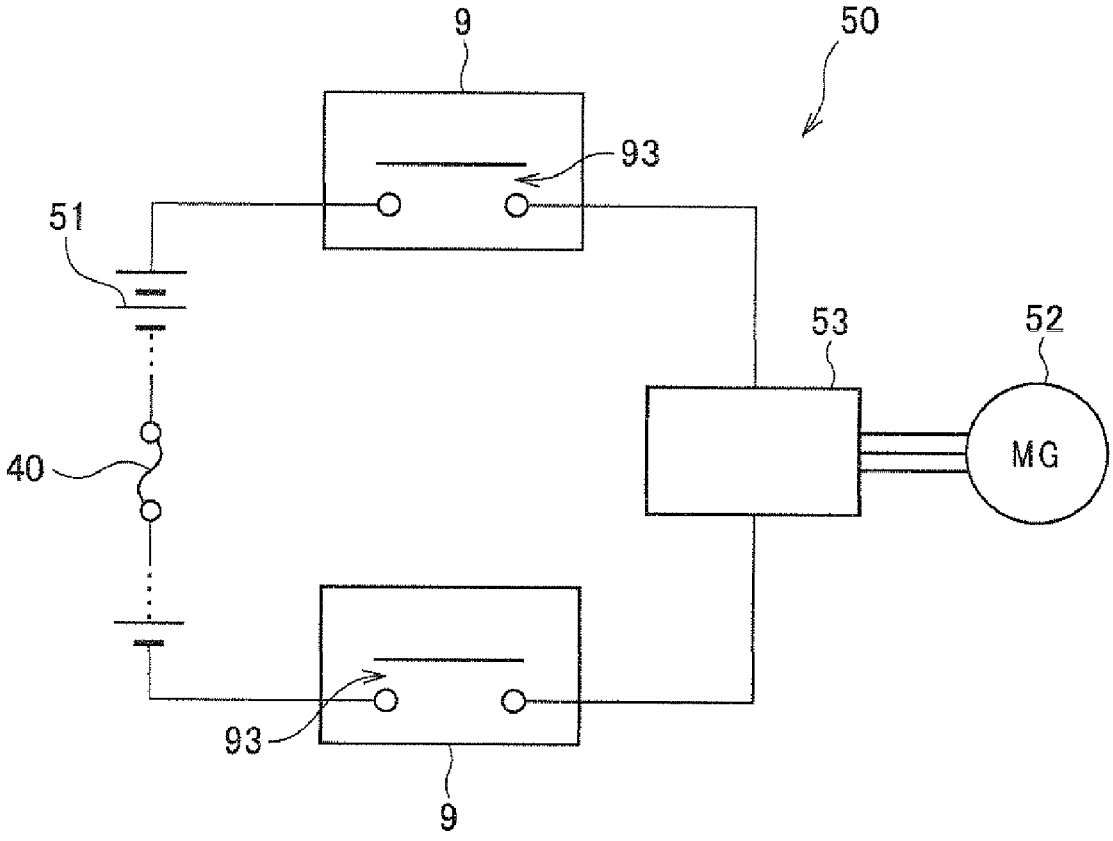
FIG. 1 PRIOR ART
FIG. 1 is a circuit diagram of a conventional example of a power circuit incorporating an electromagnetic relay.
Figure 2:
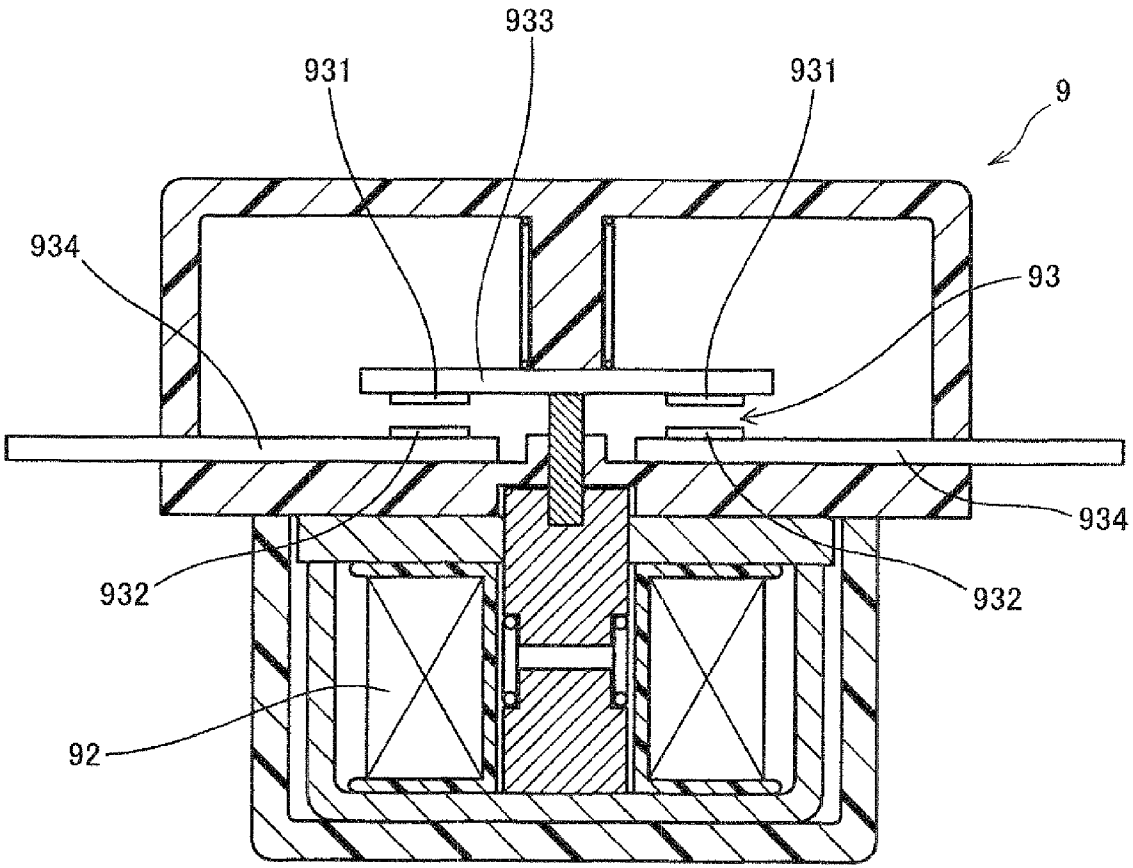
FIG.2 PRIOR ART
FIG. 2 is a cross-sectional view of the electromagnetic relay in cut-off state of the conventional example.
Figure 3:
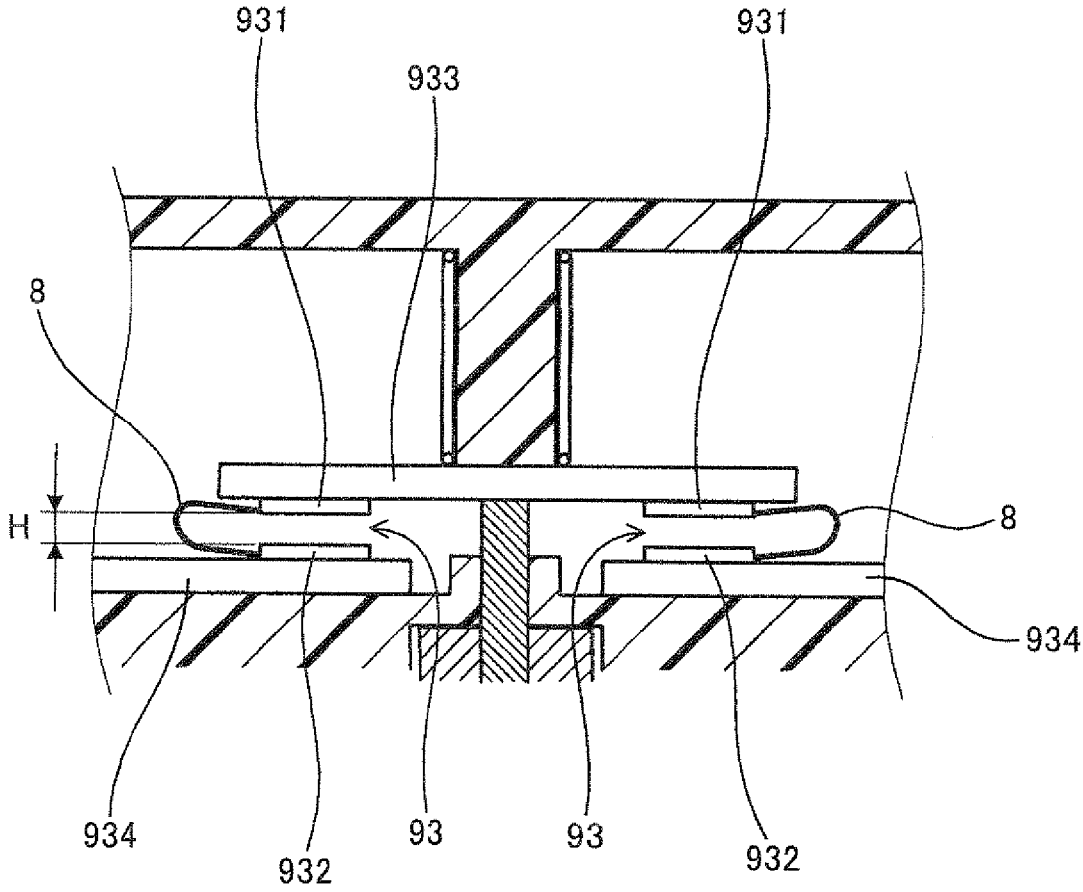
FIG.3 PRIOR ART
FIG. 3 is a cross-sectional view of a contact point part at arc generation of the conventional example.
Figure 4:
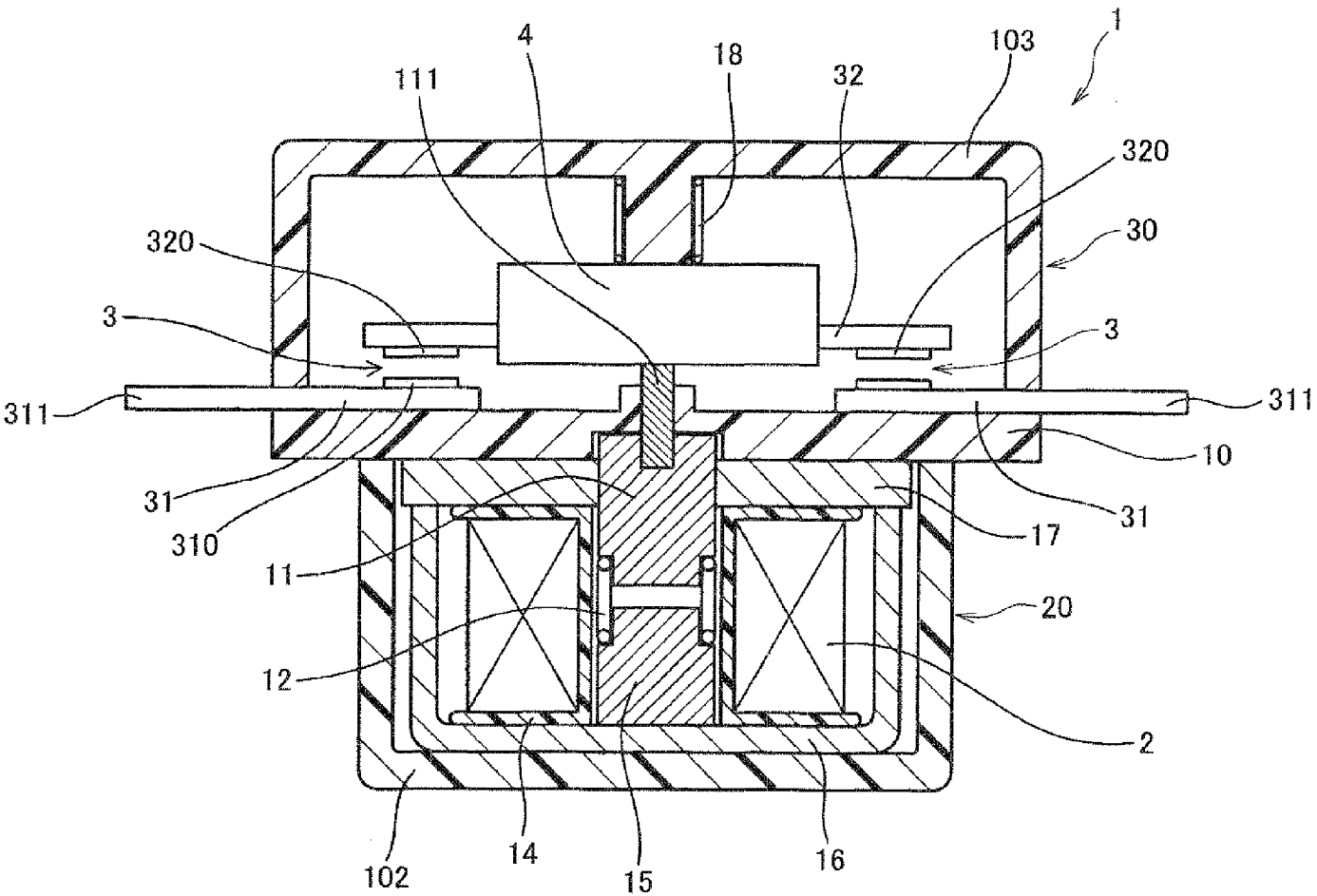
FIG. 4 is a cross-sectional view of an electromagnetic relay in cut-off state of the first embodiment.
Figure 5:
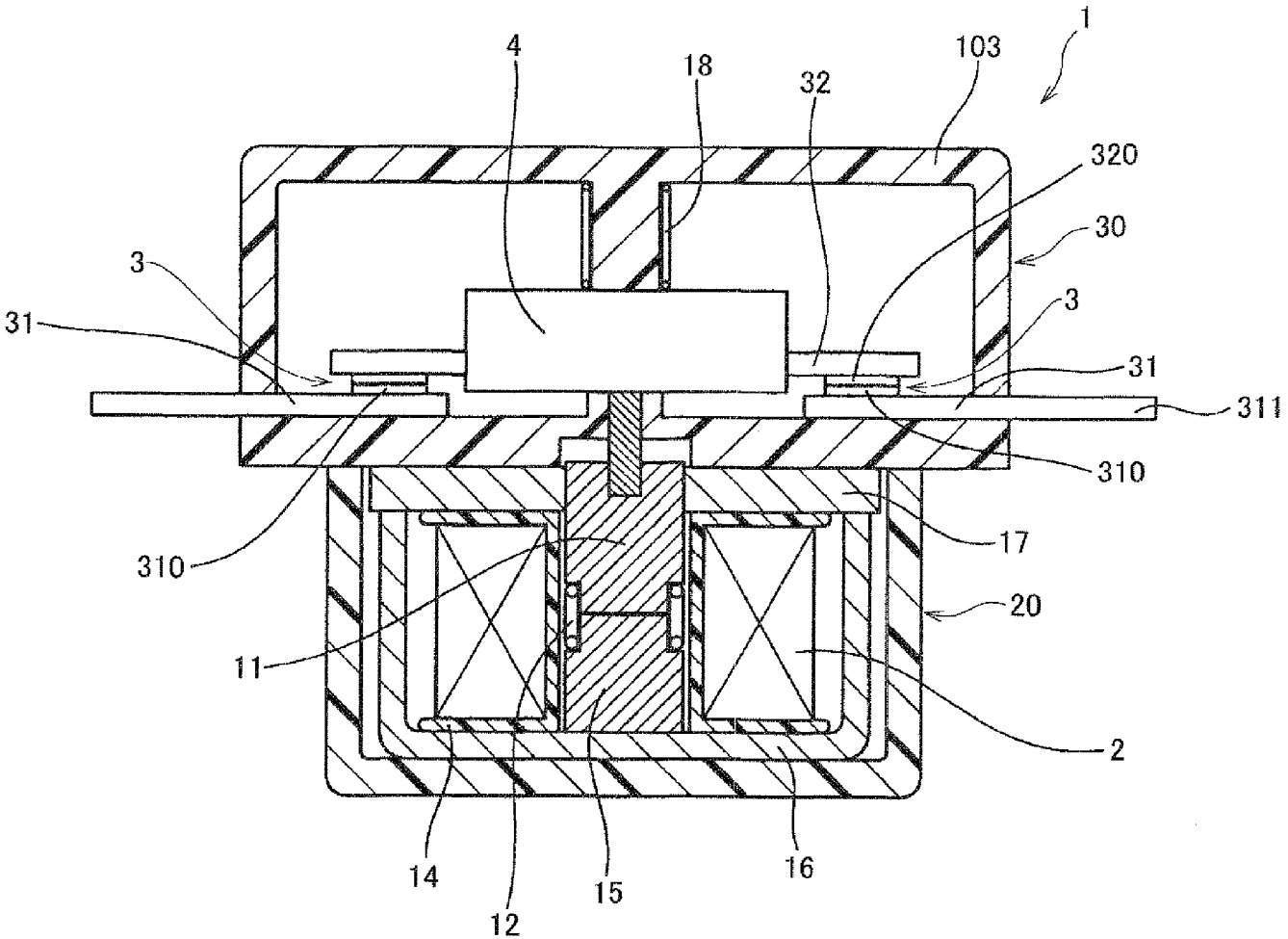
FIG. 5 is a cross-sectional view of the electromagnetic relay in conduction state of the first embodiment.

As shown in FIG. 4 and FIG. 5, the electromagnetic relay 1 of the present embodiment comprises a coil 2 which generates magnetic force when power is distributed, a contact point part 3 which is opened and closed by magnetic force, and a fuse functional part 4 which has a conductor wired electrically in series with the contact point part 3 and is disconnected when predetermined heat quantity is received.

The fuse functional part is disposed at a position which receives heat from an arc 8 (shown in FIG. 7) generated in the contact point part 3 when switching the contact point part 3 from conduction state (shown in FIG. 5) to cut-off state (shown in FIG. 4).

The electromagnetic relay 1 also comprises a pair of fixed holders 31 fixed to a main body 10 and holding a pair of fixed contact points 310, and a movable holder 32 holding in a short-circuited state a pair of movable contact points 320 disposed oppositely to the pair of fixed contact points 310. The contact point part 3 is composed of the pair of fixed contact points 310 and the pair of movable contact points 320. The fuse functional part 4 constitutes a part of the movable holder 32.

As shown in FIG. 4 and FIG. 5, the electromagnetic relay 1 of the present embodiment further comprises, inside the coil 2 fixed to the main part 10, a core 15 fixed to the main body 10 and a plunger 11 which is moved forward/backward in its axial direction by the magnetic force generated by the coil 2. The plunger 11 and the core 15 are made of magnetic material. Between the plunger 11 and the core 15, a plunger energizing part 12 energizing the plunger 11 to be pressed against the movable holder 32 side is interposed The coil 2 is wound on a bobbin 14 made of resin, and inside the bobbin 14, the core 15, the plunger 11, and the plunger energizing part 12 are disposed.

Moreover, a yoke 16 and a plate 17 both made of magnetic material are provided around the coil 2. A series of the core 15, the plunger 11, the plate 17, and the yoke 16 forms a path of magnetic flux generated when power is distributed to the coil 2.

The coil 2, the plunger 11, the plunger energizing part 12, the core 15, the bobbin 14, the yoke 16, and the plate 17 constitute a coil unit 20, and are disposed in a coil case 102 made of resin.

On the other hand, the contact point part 3, the fuse functional part 4, and a holder energizing part 18 are disposed in a cartridge case 103 made of resin, and constitute a cartridge part 30 detachable from the coil unit 20.

The plunger 11 is provided with an insulator 111, made of an insulation material such as resin, at the plunger 11's end facing the movable holder 32 side. The insulator 111 abuts against the fuse functional part 4 of the movable holder 32.

Moreover, by the holder energizing part 18, and from the side opposite to the plunger 11, the movable holder 32 is energized to approach the plunger 11, i.e., the fixed holder 31. However, energizing force of the holder energizing part 18 is smaller than energizing force of the plunger energizing part 12. Thereby, while magnetic force by the coil 2 is not acting, as shown in FIG. 4, the movable holder 32 is pulled apart from the fixed holder 31 by the plunger 11. In addition, the holder energizing part 18 also abuts against the fuse functional part 4 of the movable holder 32. Moreover, the fuse functional part 4 is composed by an element provided inside a case of the fuse functional part 4, the insulator 111 of the plunger 11, and the holder energizing part 18 abut against the case of the fuse functional part 4.

The pair of movable contact points 320 are fixed to the movable holder 32 made of a metal plate by swaging or welding so that these movable contact points 320 may be short-circuited to each other. The pair of fixed contact points 310 are fixed to the fixed holder 31 made of a metal plate by swaging or welding.

Moreover, one end of the fixed holder 31 opposite to the end where the fixed contact point 310 is disposed is exposed to the outside as an external terminal 311.

Moreover, a current value range which disconnects the fuse functional part 4 with arc heat and Joule heat is adjusted by adjusting at least one of the length X (shown in FIG. 11) between the contact point parts 3 and the fuse functional parts 4 of the movable holder 32, and the cross-sectional area S of this portion. That is, the current value range which disconnects the fuse functional part 4 with arc heat and Joule heat shifts to the lower one by shortening the length X or by changing a cross-sectional area S larger. Alternatively, the current value range can be shifted to the higher one by lengthening the length X or by changing the cross-sectional area S smaller.

Next, an operation of the electromagnetic relay of the present embodiment will be explained in detail.

When power is distributed to the coil 2, as shown in FIG. 5, a conduction state where the pair of movable contact points 320 and the pair of fixed contact points 310 contact each other is formed.

That is, magnetic flux is generated around the coil 2 when power is distributed to the coil 2. Here, the magnetic force generated by power distribution to the coil 2 is larger than energizing force given by the plunger energizing part 12. Therefore, the plunger 11 is attracted in the direction approaching the core 15 by the magnetic force. Meanwhile, as shown in FIG. 5, the plunger energizing part 12 is pressed by the plunger 11 against the coil 2 side, and is shrunk.

On the other hand, the movable holder 32 is pressed by the holder energizing part 18 against the fixed holder 31 side. So, the movable holder 32 moves to the fixed holder 31 side along with the plunger 11, and the movable holder 32 and the plunger 11 integrally move to the position where the pair of movable contact points 320 contacts the pair of fixed contact points 310.

Even after the movable contact point 320 contacts the fixed contact point 310, since the plunger 11 is attracted as it is to the coil 2 side, the movable holder 32 is separated from the plunger 11 at this time. Moreover, the movable holder 32 is pressed by the holder energizing part 18 against the coil 2 side. Then the movable contact point 320 keeps abutted against the fixed contact point 310 with sufficient contact pressure, and a conduction state is formed.

In the conduction state, current flowing from the external terminal 311 of one end of the fixed holder 31, flows to the movable holder 32 through one fixed contact point 310 and the facing movable contact point 320. Then, the current passes the fuse functional part 4 and flows to the other external terminal 311 of the end of the other fixed holder 31 through the other movable contact point 320 and the facing fixed contact point 310 of another side.

Meanwhile, when power is not distributed to the coil 2, as shown in FIG. 4, a cut-off state where the movable contact point 320 does not abut against the fixed contact point 310 is formed. That is, when power is not distributed to the coil 2, since the magnetic force generated by power distribution to the coil 2 disappears, the plunger 11 is pressed by the plunger energizing part 12 against the movable holder 32 side.

More specifically, since the energizing force of the plunger energizing part 12 is larger than energizing force of the plunger energizing part 18, the movable holder 32 is pressed by the plunger 11 and is moved in the direction receding from the coil 2 along with the plunger 11. Then the movable holder 32 moves in the direction in which the pair of movable contact points 320 is separated from the pair of fixed contact points 310, and the cut-off state where the movable contact point 320 does not abut against the fixed contact point 310 is formed.

Figure 6:
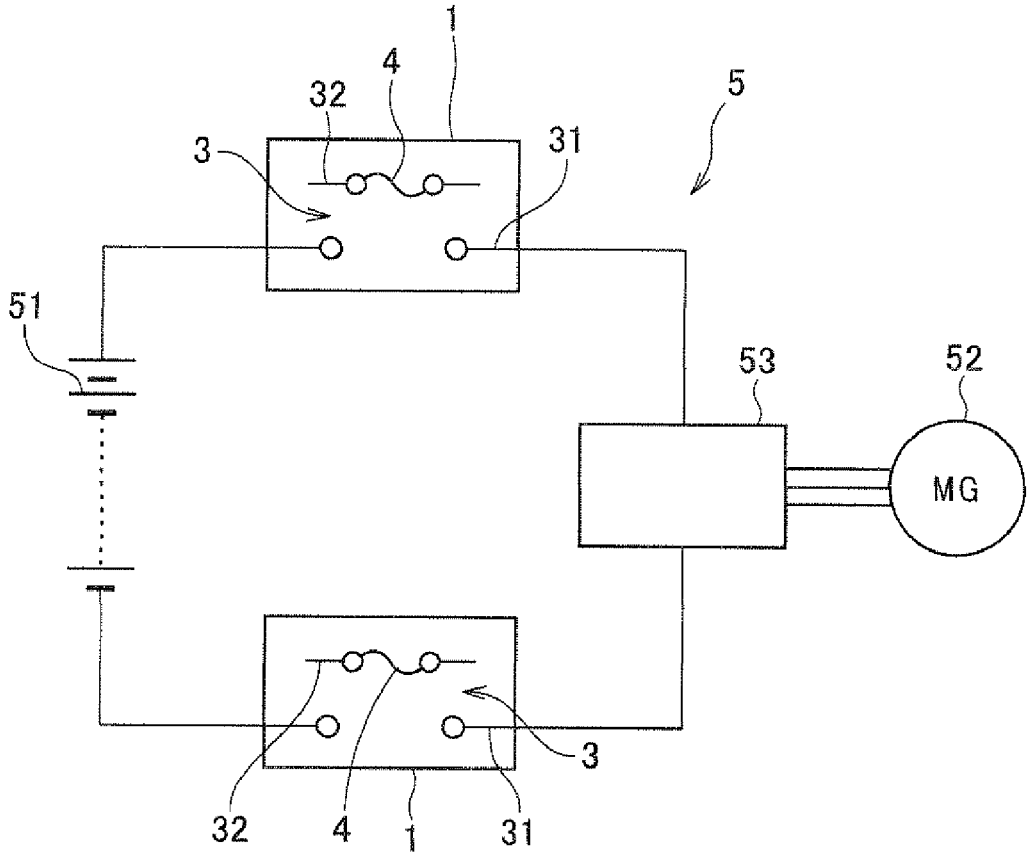
FIG. 6 is a circuit diagram of a power circuit incorporating the electromagnetic relay of the first embodiment.
Figure 7:
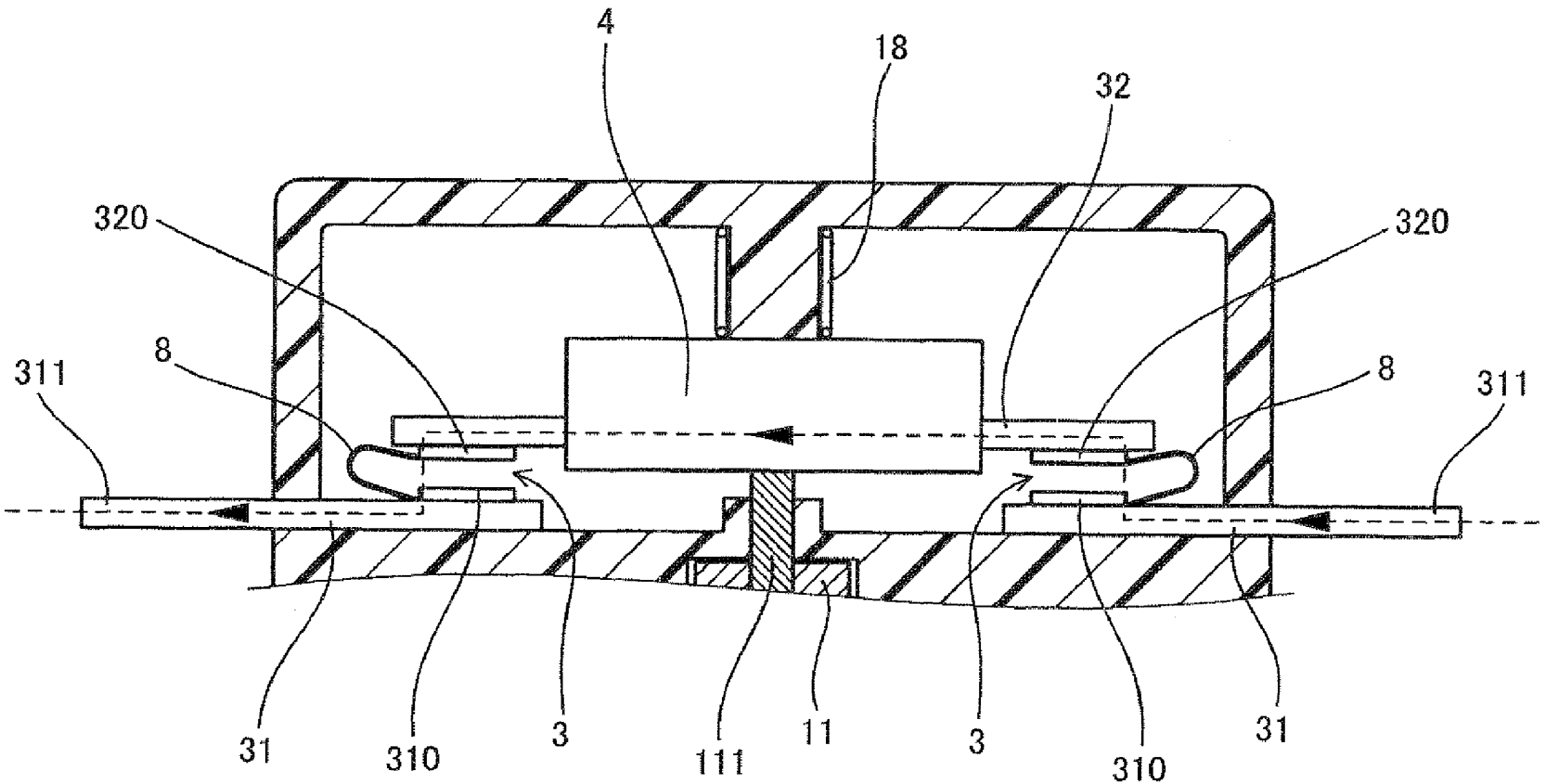
FIG. 7 is a cross-sectional view of a contact point part at arc generation of the first embodiment.

As shown in FIG. 6, the electromagnetic relay 1 is used by being incorporated into a power circuit 5 for driving a travelling motor of electric vehicles and hybrid vehicles etc.

A power circuit 5 is formed between a high-voltage battery 51 and a rotating electric machine (motor generator) 52 of three-phase AC which functions as a travelling motor, and has an inverter 53 which converts DC power (AC power) to AC power (DC power). In a positive electrode side and a negative electrode side of a current pathway between the inverter 53 and the high-voltage battery 51, the electromagnetic relay 1 is wired respectively.

In such a circuit configuration, the electromagnetic relay 1 is put into the conduction state at the time of normal operation. However, when a certain abnormality occurs in the inverter 53 or in the rotating electric machine 52, the electromagnetic relay 1 is put into the cut-off state as necessary whereby power distribution to the power circuit 5 is stopped.

Similarly, when a certain abnormality occurs in the inverter 53 or in the rotating electric machine 52 and a large current more than a predetermined value flows to the power circuit 5, the fuse functional part 4 in the electromagnetic relay 1 is disconnected whereby power distribution to the power circuit 5 is stopped. Thus, damage on the power circuit 5 or peripheral parts is minimized and safety is ensured at the time of abnormality.

Moreover, by using heat of the arc 8 generated when the contact point part 3 is converted into the cut-off state (see FIG. 7), the fuse functional part 4 can be fused with Joule heat generated by the current flowing in the fuse functional part 4 and the arc heat.

Next, operation effect of the present embodiment is explained.

The electromagnetic relay 1 incorporates the fuse functional part 4, which is disposed at the position where the fuse functional part 4 receives the heat of the arc 8. Thereby, when the contact point part 3 is converted from a conduction state to a cut-off state, the fuse functional part 4 receives not only the Joule heat generated by the current flowing in the fuse functional part 4 but also the arc heat transmitted from the contact point part 3. Therefore, even if the current too small to be interrupted only in the fuse functional part 4 and too large to be interrupted only in the contact point part 3, the current can be interrupted in a short time.

That is, at the normal time, it is necessary to prevent a situation that only the fuse functional part 4 is disconnected while the contact point part 3 is not interrupted. For this purpose, the above situation should be made to occur only when an unusual large current exceeding the current value which may flow at the normal time. In other words, it is necessary to form the fuse functional part 4 which is disconnected after receiving large heat quantity which is not generated at the normal time.

On the other hand, in the contact point part 3, while small current is flowing, since it is easy to extinguish the arc 8, it is also easy to interrupt the current. However, while to some extent large current is flowing, since it is difficult to extinguish the arc 8, it is also difficult to interrupt the current only in the contact point part 3. As described above, this problem could be solved by making the electromagnetic relay 1 larger, but it brings large disadvantages.

So, when interrupting the current whose current value range is between the current value range which can be interrupted only in the contact point part 3 and the current value range which can be interrupted only in the fuse functional part 4, the contact point part 3 is made to generate the arc 8 by converting the contact point part 3 from the conduction state to the cut-off state. The fuse functional part 4 can be disconnected by superimposing the arc heat on Joule heat.

Thereby, current in all current value ranges can be interrupted.

Figure 8:
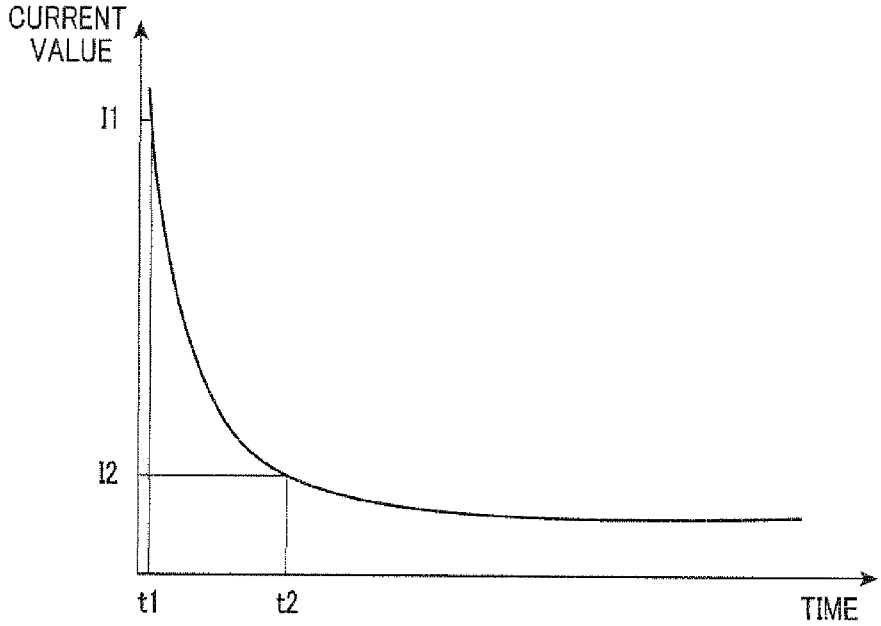
FIG. 8 is a graphic chart indicating a relation between the current value flowing in a fuse functional part and the fusing time of the fuse functional part.

Moreover, even when interrupting a large current which can be interrupted in the fuse functional part 4 only, interruption may take time depending on the current value. For example, as shown in FIG. 8, when the current value flowing in the fuse functional part 4 is I1, the fuse functional part 4 fuses in a short time t1, but when the current value I2 smaller than I1 flows in the fuse functional part 4, it takes a long time t2 that the fuse functional part 4 fuses.

In such a case, it may be possible to shorten the time taken to disconnect the fuse functional part 4 by generating the arc 8 by converting the contact point part 3 to the cut-off state as shown in FIG. 4, and then superimposing arc heat on Joule heat.

Figure 9:
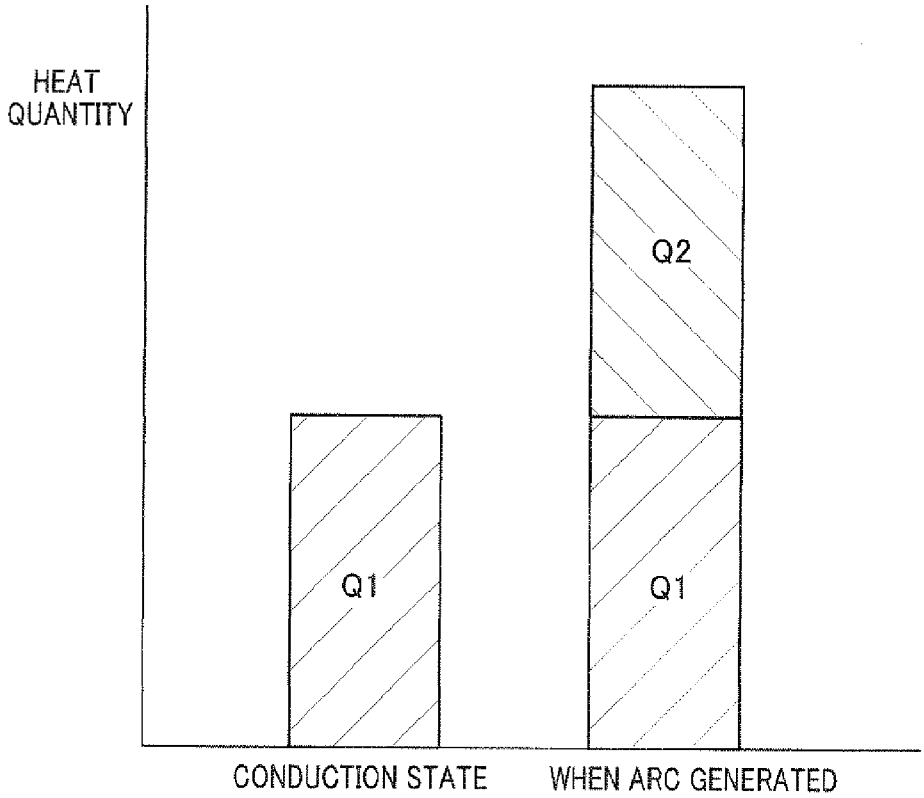
FIG. 9 is a graphic chart indicating a comparison of heat quantity at the time of Joule heat only and at the time when arc heat is superimposed on Joule heat.
Figure 10:
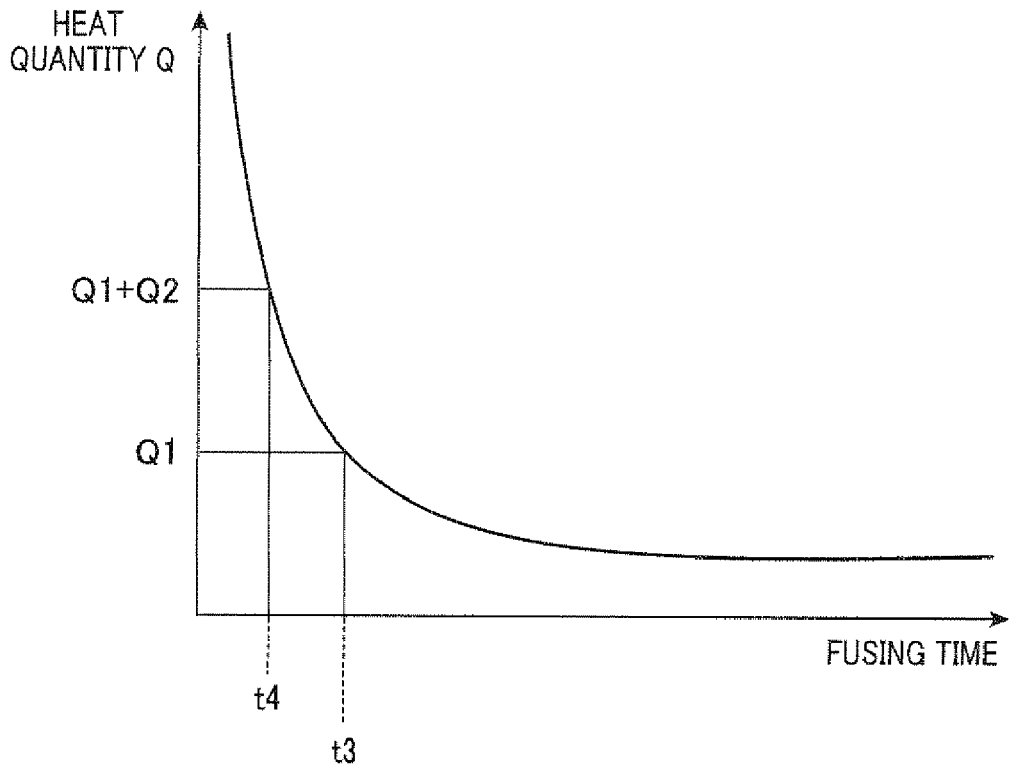
FIG. 10 is a graphic chart indicating a relation of fusing time and heat quantity which the fuse functional part receives per unit time.

That is, when interrupting current only in the fuse functional part 4 while maintaining the contact point part 3 in the conduction state as shown in FIG. 5, since the arc heat is not generated, the fuse functional part 4 should be fused only by the heat quantity Q1 of Joule heat as shown in FIG. 9. In this case, as shown in FIG. 10, when the heat quantity Q1 of Joule heat is inadequate, the fusing time t3 of the fuse functional part 4 becomes long. So by generating the arc 8 by converting the contact point part 3 to the cut-off state, the heat quantity Q2 of arc heat is superimposed on the heat quantity Q1 of Joule heat as shown in FIG. 9. Thereby, the fusing time t4 of the fuse functional part 4 can be shortened sharply as shown in FIG. 10.

Moreover, since the present invention comprises an interrupting part interrupting power distribution by fusing the fuse functional part 4 with Joule heat and arc heat, interruption only in the contact point part 3 can be limited to only when the current value is small as described above, whereby downsizing the electromagnetic relay 1 can be easy.

Furthermore, incorporating the fuse functional part 4 in the electromagnetic relay 1 makes it possible to decrease the number of parts of the circuit system.

Moreover, since the fuse functional part 4 constitutes a part of the movable holder 32, arc heat is transmitted from two directions to the fuse functional part 4, whereby the fuse functional part 4 may be easily fused in a short time. Furthermore, the fuse functional part 4 can be easily incorporated in the electromagnetic relay 1, whereby the small electromagnetic relay 1 can be obtained.

Figure 11:
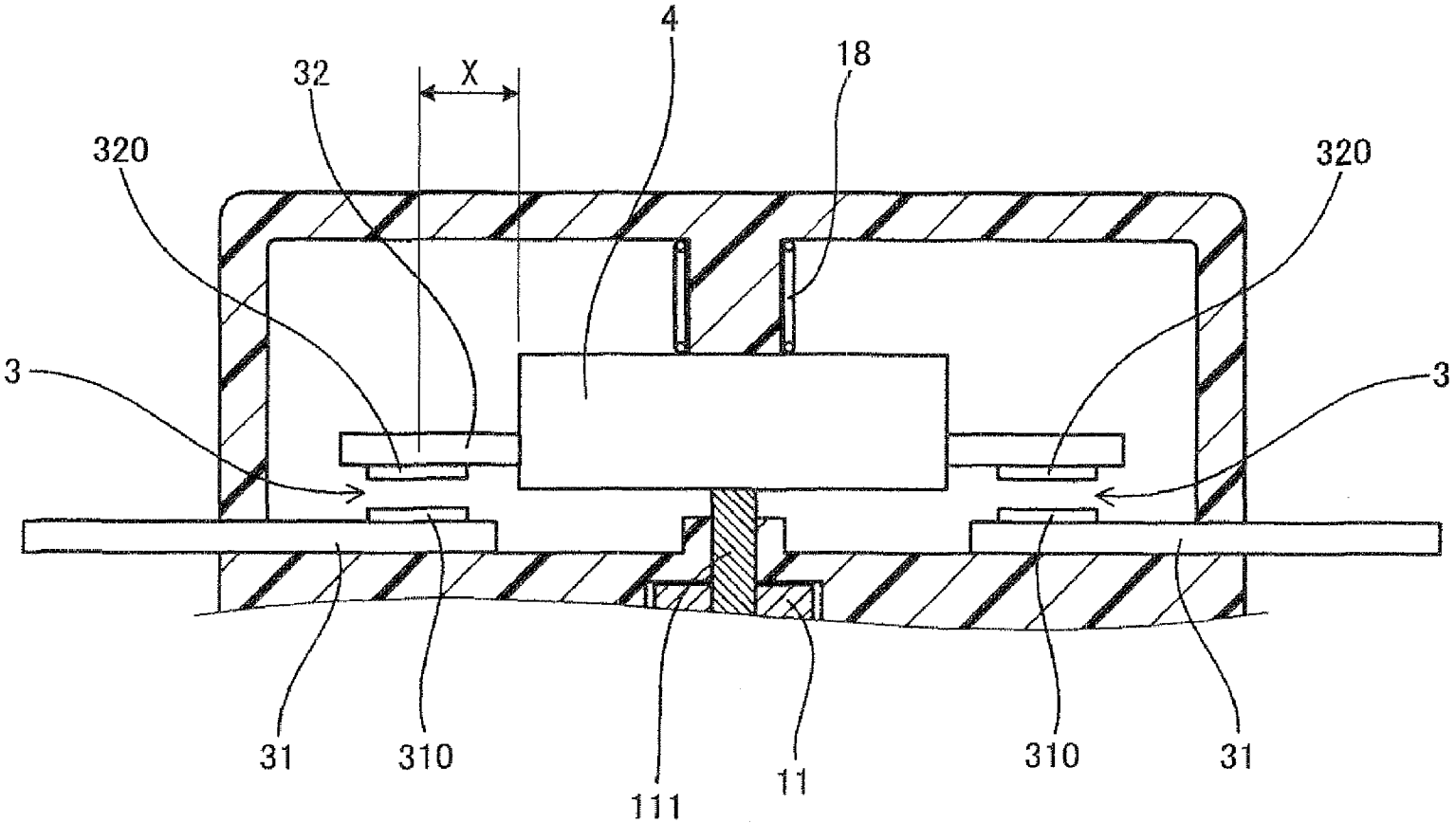
FIG. 11 is an explanatory diagram explaining the distance from the contact point part to the fuse functional part.

Moreover, the current value range which disconnects the fuse functional part 4 with arc heat and Joule heat is adjusted by adjusting at least one of the length X shown in FIG. 11 between the contact point part 3 and the fuse functional part 4 in the movable holder 32, and the cross-sectional area S of this portion of the movable holder 32. Thereby, the current value range which disconnects the fuse functional part 4 with arc heat and Joule heat can be set up easily.

As described above, the current value range shifts to the lower one by shortening the length X or by changing a cross-sectional area S larger. Alternatively, the current value range shifts to the higher one by lengthening the length X or by changing the cross-sectional area S smaller.

Moreover, the electromagnetic relay 1 comprises the coil unit 20 and the cartridge part 30 detachable from the coil unit 20. Therefore, when the fuse functional part 4 is disconnected, or when the contact point part 3 is damaged, the cartridge part 30 can be removed from the coil unit 20 and then replaced.

As described above, according to the present embodiment, a small electromagnetic relay which enables interruption of current in all current value range can be provided.

Second Embodiment

Figure 12:
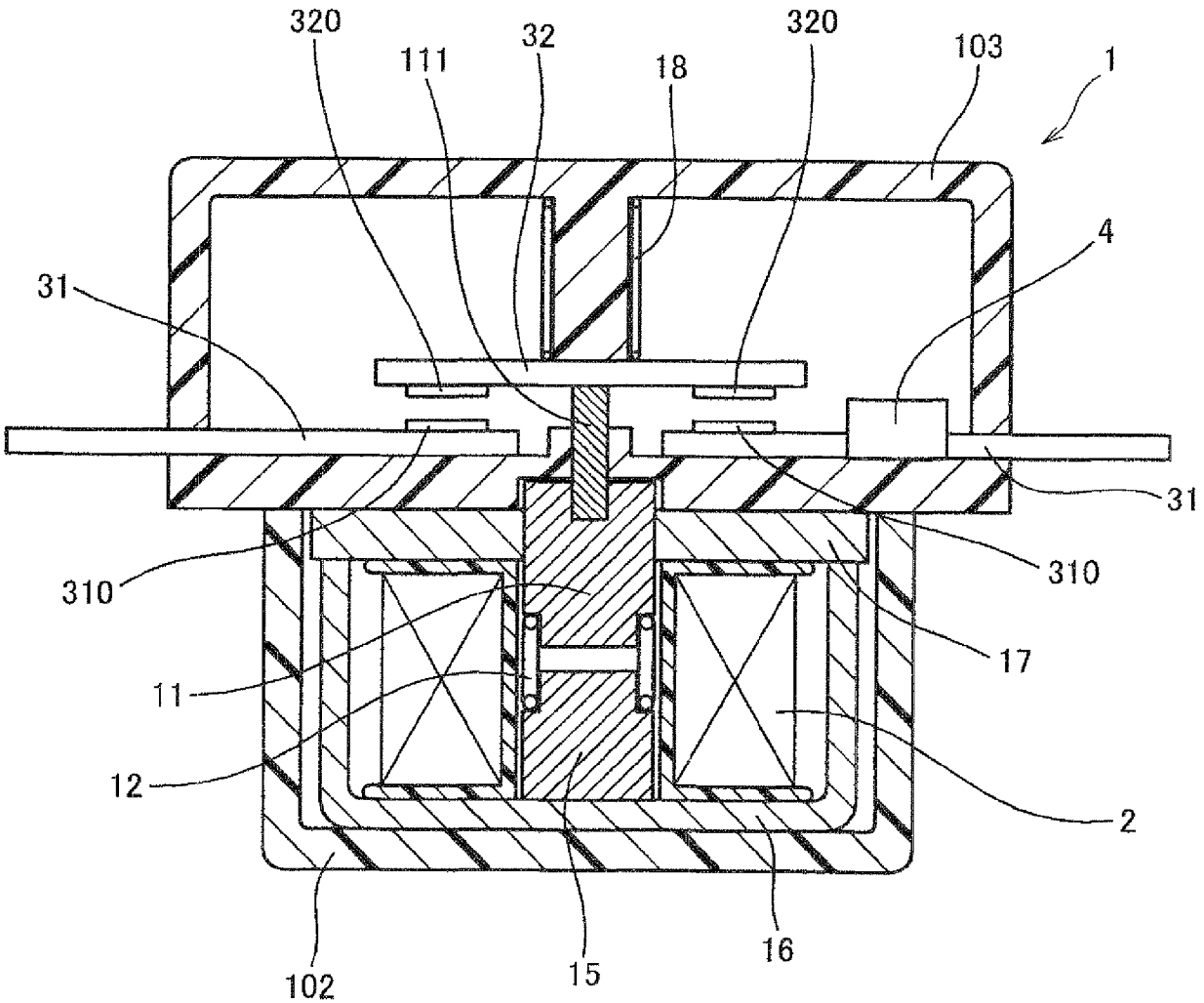
FIG. 12 is a cross-sectional view of an electromagnetic relay in cut-off state of the second embodiment.

The present embodiment exemplifies the electromagnetic relay 1 in which the fuse functional part 4 constitutes a part of the fixed holder 31 as is shown in FIG. 12.

That is, the fuse functional part 4 is interposed between the fixed contact point 310 and the external terminal 311 in the fixed holder 31. Moreover, the fuse functional part 4 is disposed inside the cartridge case 103.

Other configuration is the same as that of the first embodiment.

In this embodiment also, the fuse functional part 4 can be provided in the position where arc heat is fully transmitted.

Other configuration has the same the operation effect as that of the first embodiment.

Third Embodiment

Figure 13:
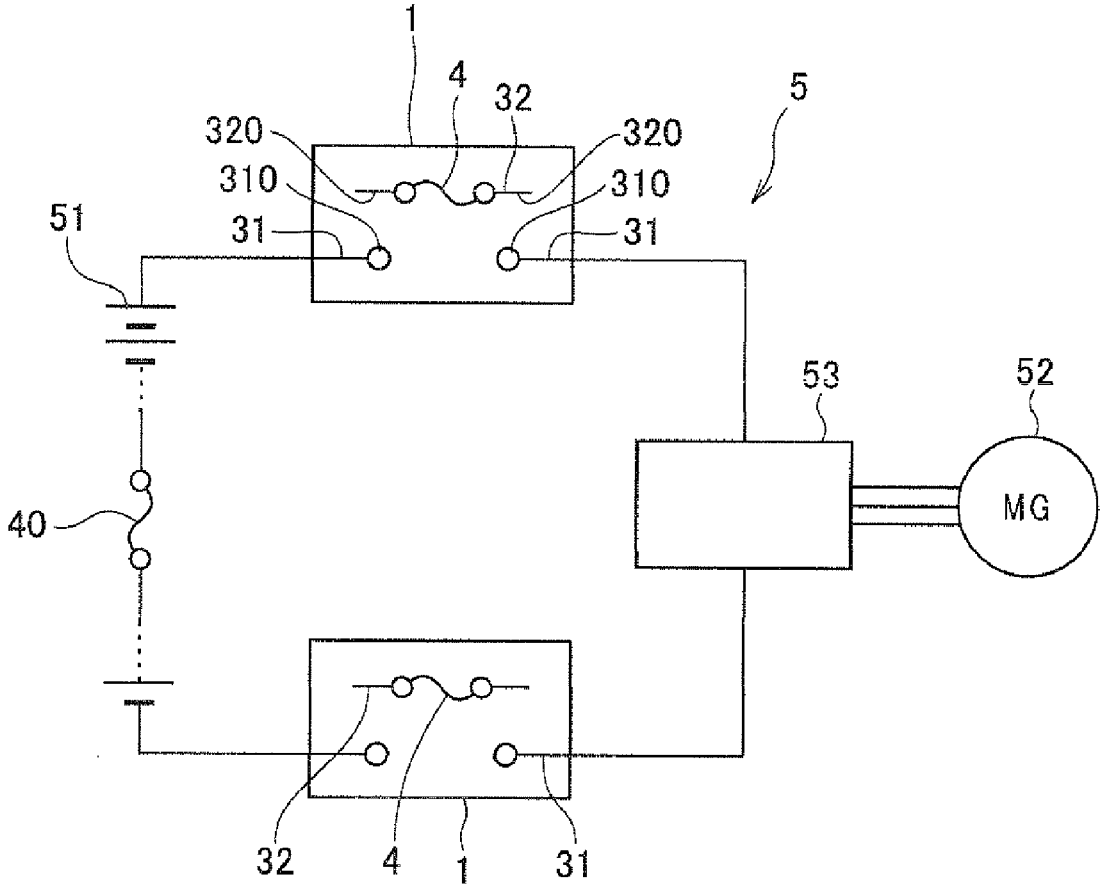
FIG. 13 is a circuit diagram of a power circuit incorporating an electromagnetic relay of the third embodiment.

The present embodiment shows an example that the power circuit 5 incorporated in the electromagnetic relay 1 of the first embodiment as shown in FIG. 13.

That is, in the present embodiment, the high-voltage battery 51 incorporating the fuse functional part 40 is used.

Other features are the same as the case of the first embodiment.

In the present embodiment, the power circuit 5 is interrupted in the contact point part 3 of the electromagnetic relay 1, in the fuse functional part 4 incorporated in the electromagnetic relay 1, and three kinds of interruption parts of the fuse functional part 40 incorporated in the high-voltage battery 51.

Others have the same operation effect as those of the first embodiment.

What is claimed is:

1. An electromagnetic relay comprising:

a coil that generates magnetic force when current is supplied thereto, a contact point part opened and closed by the magnetic force, and a fuse functional part electrically connected in series to the contact point part and formed of a conductor which is disconnected when a predetermined heat quantity is received, wherein:

the fuse functional part is arranged at a position that receives arc heat generated in the contact point part when the contact point part is switched from a conduction state to a cut-off state;

the electromagnetic relay has a pair of fixed holders that hold a pair of fixed contact points fixed to a main body, and a movable holder that holds a pair of movable contact points in a short-circuited state, the pair of movable contact points being arranged opposed to the pair of fixed contact points, the contact point part is provided by the fixed and movable contact points, and the fuse functional part is at least a part of the movable holder;

a length and a cross-sectional area of a first part of the movable holder are set such that current of a first range flowing into the electromagnetic relay disconnects the fuse functional part due to both arc heat and Joule heat of current passing through the fuse functional part, the first part being interposed between a contact point part and the fuse functional part, the first range being smaller than current of a second range which disconnects the fuse functional part due only to Joule heat of current passing through the fuse functional part.

2. The electromagnetic relay according to claim 1, further comprising a cartridge case wherein the contact point part and the fuse functional part are disposed and the cartridge case is configured to be detachable from a coil unit that includes the coil.

3. The electromagnetic relay according to claim 1, wherein the contact point part is configured to be opened when current of the first range flows into the electromagnetic relay.

4. The electromagnetic relay according to claim 3, wherein the fuse functional part is disconnected when the contact point part is closed and the current of the second range flows into the electromagnetic relay.

5. The electromagnetic relay according to claim 3, wherein the first range is larger than a third current value range which causes interruption only in the contact point part.

6. The electromagnetic relay according to claim 1, wherein the first range is larger than a third current value range which causes interruption only in the contact point part.

7. The electromagnetic relay according to claim 1, wherein the movable holder is moved by and through movement of the fuse functional part.

* * * * *